US005720104A

United States Patent [19]

Decker

[11] Patent Number: 5,720,104

[45] Date of Patent: Feb. 24, 1998

[54] DRYWALL SHEET TRIMMER

[76] Inventor: Mark Decker, 215 N. Lake Ave., Lehigh Acres, Fla. 33972

[21] Appl. No.: 790,766

[22] Filed: Jan. 27, 1997

[51] Int. Cl.[6] ..... B26B 29/06

[52] U.S. Cl. ..... 30/293; 30/294; 30/292

[58] Field of Search ..... 30/286, 287, 292, 30/293, 294; 83/883, 885, 468.2, 468.7; 33/32.2, 42

[56] References Cited

U.S. PATENT DOCUMENTS

| | | | |
|---|---|---|---|
| 2,529,210 | 11/1950 | Butler | 30/294 |
| 2,706,002 | 4/1955 | Whittamore | 30/292 |
| 3,174,225 | 3/1965 | Abraham | 30/293 |
| 4,495,697 | 1/1985 | Ruff | 30/294 |
| 5,027,515 | 7/1991 | Murdock | 30/294 |
| 5,083,375 | 1/1992 | Helm, Sr. | 30/294 |
| 5,488,773 | 2/1996 | Fletcher | 30/293 |
| 5,600,892 | 2/1997 | Peugh et al. | 30/292 |

*Primary Examiner*—Hwei-Siu Payer
*Attorney, Agent, or Firm*—Merrill N. Johnson

[57] ABSTRACT

A compact, reliable and convenient drywall-sheet trimmer has opposed cutter disks (7, 8) positioned rotationally in opposing walls (3, 4) of a trimmer channel (2) having a slide bar (19) that is adjustable in positioning intermediate the opposing cutter disks and a channel bottom (21). Pinion teeth (25) on an adjustment shaft (24) are rotated by helical worm gearing (28) with an adjustment knob (30) to actuate rack teeth (26) on slide rods (22) attached to the slide bar for adjusting distance of the slide bar from the cutter disks to control widths of trimming cuts. Surfaces of drywall sheets (6) are scored or cut to cause the drywall sheets to be breakable by applying bending moment along lines of scored or cut surface material and/or indentations caused by cutting entry of the opposed cutter disks.

13 Claims, 1 Drawing Sheet

DRYWALL SHEET TRIMMER

BACKGROUND OF THE INVENTION

1. Field of the Invention

This invention relates to tools for trimming or scoring of sheets of drywall, plasterboard, wallboard and other types of sheets of interior walls in construction of buildings.

2. Relation To Prior Art

Previous tools for trimming or scoring of sheets of drywall, plasterboard, wallboard and other types of sheets of interior walls during construction of buildings have been too bulky, hard to handle and inconvenient for satisfactory use by construction workers.

Different but related tools for trimming or scoring interior-wall sheets are described in the following patent documents. U.S. Pat. No. 5,488,773, issued to Fletcher, taught a material-scoring apparatus having a pair of arms with a proximal end of one attached rigidly and a proximal end of the other pivotally attached to a shoulder. Scoring cutters attached to distal ends were brought together for cutting opposite sides of an interior-wall sheet while distance of the cutting from an edge was maintained by a channel that was positioned selectively intermediate the proximal and distal ends of the arms.

U.S. Pat. No. 5,027,515, issued to Murdock, was limited to cutting wheels in combination with rollers on threaded shafts with ball-bearing bushings in opposite faces of a channel. It did not have cutting wheels independently of rollers and ball bearings. In addition, means it taught for positioning a cut-width guide in the channel were different than a worm-and-rack system taught by this invention.

U.S. Pat. No. 4,495,697, issued to Ruff, taught a trimming tool that used fixed instead of rotary cutters.

U.S. Pat. No. 3,174,225, issued to Abraham, teaches opposing disc cutter on ends of legs attached with adjustable distance of separation and having a controllable edge-distance positioner.

U.S. Pat. No. 2,529,210, issued to Butler, taught a cutting apparatus that had cut-width control of long arms and an edge follower that made it too large for carrying on a tool belt for the bulk of sheet-trimming work required.

SUMMARY OF THE INVENTION

In light of need for improvement of trimmers for interior-wall sheets, objects of this invention are to provide a drywall-sheet trimmer which:

Is small and light enough to be carried conveniently on a tool belt of a worker at construction sites;

Cuts cleanly and evenly to desired scoring depths;

Requires minimal energy for use; and

Is accurate, reliable and long lasting.

This invention accomplishes these and other objectives with a drywall-sheet trimmer having opposed cutter disks positioned rotationally in opposing walls of a trimmer channel having a slide bar that is adjustable in positioning intermediate the opposing cutter disks and a channel bottom. A pinion gear on an adjustment shaft is rotated by a helical worm gear with an adjustment knob to actuate rack gears on slide rods attached to the slide bar for adjusting distance of the slide bar from the cutter disks to control widths of trimming cuts. Surfaces of drywall sheets are scored or cut to cause the drywall sheets to be breakable by applying bending moment along lines of scored or cut surface material and/or indentations caused by cutting entry of the opposed cutter disks.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
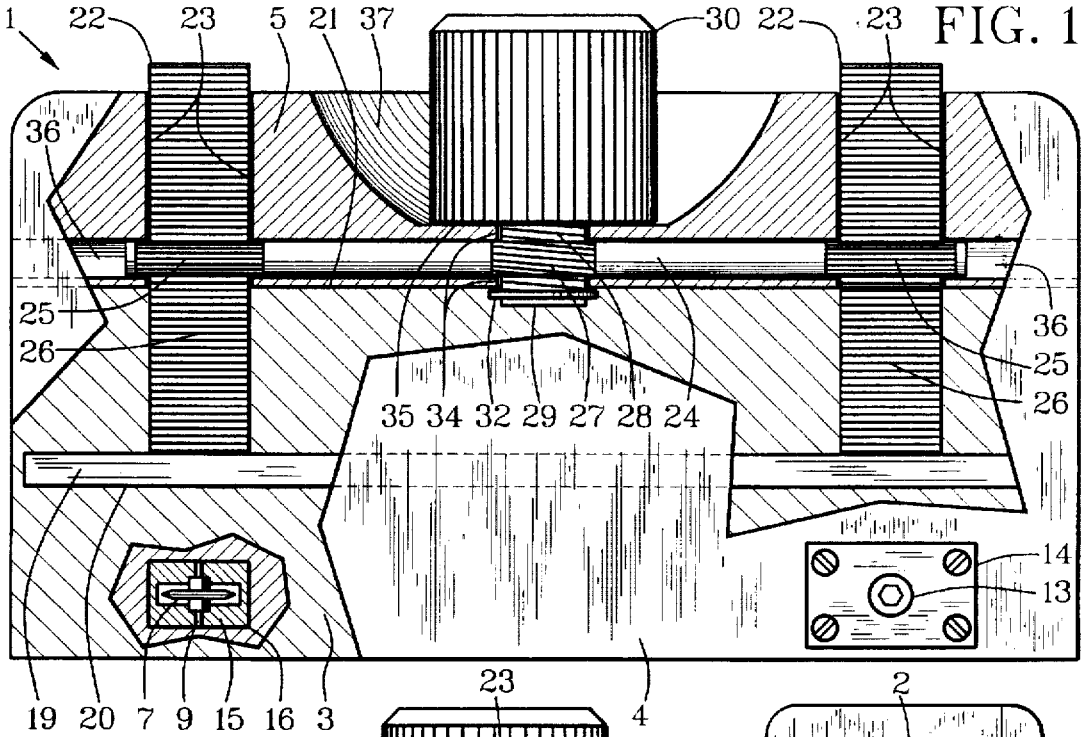
FIG. 1 is a partially cutaway side elevation view.

Reference is made to all of FIGS. 1–4 with special reference for particular items. A trimmer body 1 has a trimmer channel 2 with a first channel wall 3, a second channel wall 4 and a channel base 5. The first channel wall 3 and the second channel wall 4 are parallel and extended a design distance from the channel base 5. A distance between an inside surface of the first channel wall 3 and the second channel wall 4 is sufficient to allow designedly sliding entry of a sheet of material 6, shown in FIG. 2, to be cut between the inside surface of the first channel wall 3 and the second channel wall 4.

At least one first-wall cutter disk 7 is positioned in the first channel wall 3 and at least one second-wall cutter disk 8 is positioned in the second channel wall 4. Rotational axes 9 of the first-wall cutter disk 7 and the second-wall cutter disk 8 are parallel to the first channel wall 3 and the second channel wall 4 respectively and are perpendicular to the channel base 5. The first-wall cutter disk 7 and the second-wall cutter disk 8 are oppositely disposed with a design distance intermediate a first-disk cutting edge 10 and a second-disk cutting edge 11.

Preferable design distance intermediate the first-disk cutting edge 10 and the second-disk cutting edge 11 is sufficient to cut through an outside layer 12 on material 6 to be cut. Cutting through the outside layer 12 and optionally making a slight indentation in the material 6 allows the material 6 to be broken easily and evenly by applying a bending moment generally along a line of cut of the outside layer 12. This cutting is referred to generally in the trade as scoring.

Some types of materials 6 require deeper cuts than others. Usually, however, the same type of material will be used throughout a building project, such that depths of cuts need not be adjustable and the drywall-sheet trimmer can be lighter and more rigid for easier cutting than though it were made adjustable. If cut-depth adjustment is desired, however, it can be provided with an adjustment means such as a set screw 13 in a cutter plate 14 to engage housing 15 in a housing aperture 16.

Figure 4:
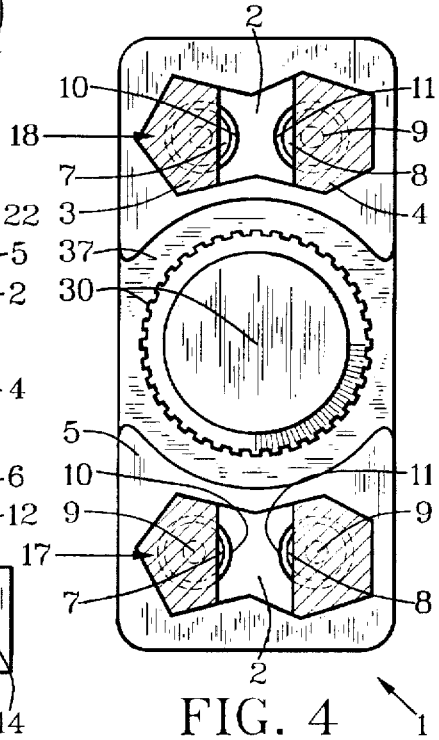
FIG. 4 is a partially cutaway top view showing different distances between separate sets of cutter disks in cutaway portions.

A plurality of at least two sets of first-wall cutter disks 7 and second-wall cutter disks 8 in a common plane of cutting can be provided as depicted in FIG. 4. Distances between inside cutting edges, such as between the first-disk cutting edge 10 and the second-disk cutting edge 11, of a plurality of sets of cutter disks 7 and 8 can be provided. This allows shallow cutting with a first set of cutters 17 and progressively deeper cutting with a successive set of cutters 18 for some types of materials. Either or all cutter disks can be either fixed or adjustable in distances between cutting edges 10 and 11.

Width of trim from edges of the material 6 can be selected and evened accurately with a slide bar 19 having a guide surface 20 that is generally parallel to a channel floor 21 of the channel base 5. The slide bar 19 is positioned between the inside surface of the first channel wall 3 and the second channel wall 4 and has a sufficient length for lateral positioning stability of an edge of the material 6 such as drywall sheet being trimmed. Length of the slide bar 19 can be approximately equal to length of the trimmer body 1 if the particular trimmer body 1 is sufficiently long. A slide bar 19 slightly shorter than a trimmer body 1 is shown in FIG. 1.

At least one and preferably two slide rods 22 are extended from the slide bar 19 and positioned in sliding contact with slideways 23 on the trimmer body 1. The slideways 23 can be slideway apertures in the channel base 5 as depicted in FIGS. 1–2. The slide rods 22 are slid outwardly in a direction away from the channel floor 21 and towards the cutter disks 7 and 8 to decrease width of material 6 to be trimmed off. Conversely, the slide rods 22 are slid inwardly in a direction towards the channel floor 21 and away from the cutter disks 7 and 8 to increase width of material 6 to be trimmed off. Any of several means can be used to slide the slide rods 22 to position the slide bar 19 for setting a trim width.

A preferred means to slide the slide rods 22 is with an adjustment shaft 24 having pinion teeth 25 that engage rack teeth 26 on the slide rods 22 with rack-and-pinion gearing. The adjustment shaft 24 has toothed gearing 27 that is engaged by helical worm gearing 28 on a knob shaft 29 of an adjustment knob 30. Hand-rotation of the adjustment knob 30 rotates the knob shaft 29 which rotates the adjustment shaft 24 to engage the pinion teeth 25 with the rack teeth 26 for sliding the slide rods 22 and, consequently, positioning the slide bar 19 in accordance with directional rotation of the adjustment knob 30. The adjustment knob 30 can have serrated walls that are parallel as depicted in FIGS. 1–2 and 4 or a coned section 31 as depicted in FIG. 3.

Figure 2:
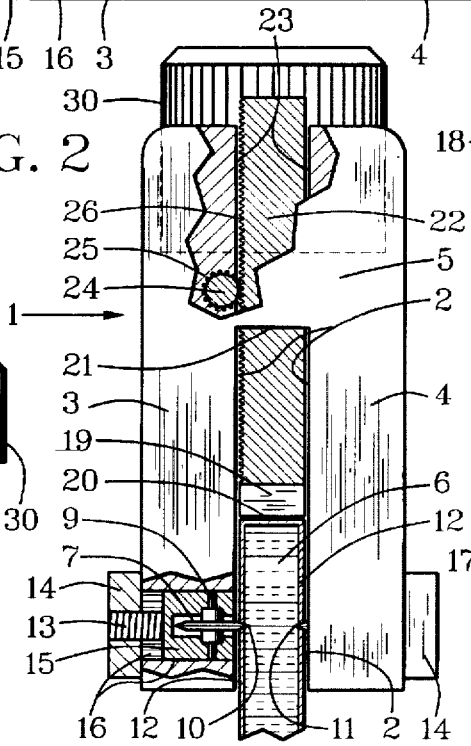
FIG. 2 is a partially cutaway end elevation view.
Figure 3:
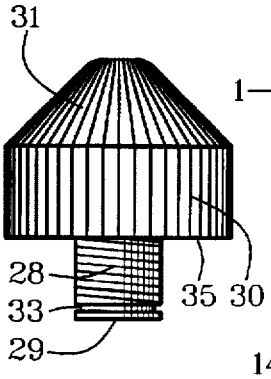
FIG. 3 is an elevation view of a helical gear on a bottom of an adjustment knob that has a conical top.

Upwardly linear thrust of the knob shaft 29 can be absorbed by a thrust ring 32, shown in FIG. 1, in a ring groove 33, shown in FIG. 3, in the knob shaft 29. The thrust ring 32 buttresses against a portion of the channel floor 21 that surrounds a knob-shaft aperture 34. Downwardly linear thrust of the knob shaft 29 can be absorbed by a knob surface 35 that slides rotationally on a portion of the channel base 5 that surrounds the knob-shaft aperture 34.

The adjustment shaft 24 can be inserted in an adjustment-shaft aperture 36 in the channel base 5 or positioned otherwise in accordance with design preferences. Optionally, the channel base 5 can be constructed in sections that are joined to enclose portioned apertures for containing the slideways 23, the adjustment shaft 24 and/or the knob shaft 29. A knob well 37 also is optional. The coned section 31 allows fast turning at a central portion and slower accurate positioning at a major diameter. These and other constructional options are foreseeable.

Helical gearing in combination with rack-and-pinion gearing is preferable to other means for actuating slide rods 22 for several reasons. It is convenient, reliable and easy to construct. Reliability results from incapacity of the adjustment shaft 24 to be rotated by the slide rods 22 and thereby to change a trim-width setting undesirably when the helical gearing 28 has a lead angle of less than seven degrees and the toothed gearing 27 on the adjustment shaft 24 has a matching lead angle. This prevents cam action that is inverse to input cam action from rotation of the adjustment knob 30.

A new and useful drywall-sheet trimmer having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A drywall-sheet trimmer comprising:

a trimmer body having a trimmer channel with a first channel wall, a second channel wall and a channel base with a channel floor;

the first channel wall and the second channel wall being parallel and extending along a predetermined distance from the channel base;

the first channel wall and the second channel wall are positioned apart a distance to allow sliding entry of a sheet of material to be cut to predetermined depths between an inside surface of the first channel wall and an inside surface of the second channel wall;

at least one first-wall cutter disk positioned rotationally in the first channel wall and having a rotational axis perpendicular to the channel floor and parallel to the first channel wall;

at least one second-wall cutter disk positioned rotationally in the second channel wall and having a rotational axis perpendicular to the channel floor and parallel to the second channel wall;

the first-wall cutter disk and the second-wall cutter disk being oppositely disposed with a predetermined distance intermediate a circumferential cutting edge of the first-wall cutter disk and a circumferential cutting edge of the second-wall cutter disk;

a slide bar having a guide surface that is parallel to the channel floor and positioned between the inside surface of the first channel wall and the inside surface of the second channel wall;

at least one slide rod extended from a base side of the slide bar;

a bar-positioning means in positional communication with the slide rod;

the bar-positioning means having an adjustment shaft in rotational contact with the trimmer body;

the adjustment shaft having toothed gearing positioned circumferentially on a worm-drive section of the adjustment shaft;

an adjustment knob having helical worm gearing on a knob shaft that is in rotational contact with a knob-shaft aperture in the channel base;

the helical worm gearing is positioned in worm-drive contact with gear teeth on the adjustment shaft, such that rotation of the helical worm gearing by rotation of the adjustment knob rotates the adjustment shaft in a shaft axis that is orthogonal to a knob axis;

at least one slideway on the trimmer body;

the slide rod being in sliding contact with the slideway;

the adjustment shaft has at least one pinion gear with pinion teeth; and the at least one slide rod has rack teeth that are sized, shaped, structured and positioned to mesh with the pinion teeth, such that rotation of the adjustment shaft by selective rotation of the adjustment knob positions the slide bar selectively intermediate the channel base and a cutting section of the first-wall cutter disk and the second-wall cutter disk.

2. A drywall-sheet trimmer as described in claim 1 wherein:

the slide bar has a length sufficient to support lateral positioning stability on an edge of a drywall sheet being trimmed.

3. A drywall-sheet trimmer as described in claim 2 wherein:

the trimmer body has a length from-end-to-end of the trimmer channel that is approximately equal to length of the slide bar.

4. A drywall-sheet trimmer as described in claim 1 wherein:

the at least one first-wall cutter disk has a plurality of first-wall cutter disks;

the at least one second-wall cutter disk has a plurality of second-wall cutter disks;

circumferential cutting edges of the plurality of first-wall cutter disks lie in a common plane that is perpendicular to the first channel wall; and circumferential cutting edges of the plurality of second-wall cutter disks lie in a common plane that is perpendicular to the second channel wall.

5. A drywall-sheet trimmer as described in claim 4 wherein:

distances between inside cutting edges of the plurality of first-wall cutter disks and the plurality of second-wall cutter disks are different for particular use conditions.

6. A drywall-sheet trimmer as described in claim 4 wherein:

the at least one slide rod has a plurality of slide rods having rack teeth;

the at least one slideway has a plurality of slideways which match the plurality of slide rods;

the adjustment shaft has a plurality of pinion gears with pinion teeth; and the plurality of slide rods have rack teeth that are sized, shaped, structured and positioned to mesh with respective pinion teeth of the plurality of pinion gears, such that rotation of the adjustment shaft by selective rotation of the adjustment knob positions the slide bar selectively intermediate the channel base and a cutting section of the first-wall cutter disk and the second-wall cutter disk.

7. A drywall-sheet trimmer as described in claim 6 wherein:

the slide bar has a length sufficient to support lateral positioning stability on an edge of a drywall sheet being trimmed; and the trimmer body has a length from-end-to-end of the trimmer channel that is approximately equal to length of the slide bar.

8. A drywall-sheet trimmer as described in claim 7 wherein:

the adjustment knob has a conically tapered top section that is extended from a cylindrical section of the adjustment knob.

9. A drywall-sheet trimmer as described in claim 1 wherein:

the at least one slide rod has a plurality of slide rods having rack teeth;

the at least one slideway has a plurality of slideways which match the plurality of slide rods;

the adjustment shaft has a plurality of pinion gears with pinion teeth; and the plurality of slide rods have rack teeth that are sized, shaped, structured and positioned to mesh with the respective pinion teeth of the plurality of pinion gears, such that rotation of the adjustment shaft by selective rotation of the adjustment knob positions the slide bar selectively intermediate the channel base and a cutting section of the first-wall cutter disk and the second-wall cutter disk.

10. A drywall-sheet trimmer comprising:

a trimmer body having a trimmer channel with a first channel wall, a second channel wall and a channel base with a channel floor;

the first channel wall and the second channel wall being parallel and extended a predetermined distance from the channel base;

the first channel wall and the second channel wall are positioned apart a distance to allow sliding entry of a sheet of material to be cut to predetermined depths between an inside surface of the first channel wall and an inside surface of the second channel wall;

at least one first-wall cutter disk positioned rotationally in the first channel wall and having a rotational axis perpendicular to the channel floor and parallel to the first channel wall;

at least one second-wall cutter disk positioned rotationally in the second channel wall and having a rotational axis perpendicular to the channel floor and parallel to the second channel wall;

the first-wall cutter disk and the second-wall cutter disk being oppositely disposed with a predetermined distance intermediate a circumferential cutting edge of the first-wall cutter disk and a circumferential cutting edge of the second-wall cutter disk;

a slide bar having a guide surface that is parallel to the channel floor and positioned between the inside surface of the first channel wall and the inside surface of the second channel wall;

at least one slide rod extended from a base side of the slide bar;

at least one slideway on the trimmer body;

the slide rod being in sliding contact with the slideway;

a bar-positioning means in positional communication with the slide rod, such that the slide bar is adjustable selectively in positioning intermediate the channel base and a cutting section of the first-wall cutter disk and the second-wall cutter disk;

the bar-positioning means in positional communication with the slide rod has an adjustment shaft in rotational contact with the trimmer body;

the adjustment shaft has toothed gearing positioned circumferentially on a worm-drive section of the adjustment shaft;

an adjustment knob having helical worm gearing on a knob shaft that is in rotational contact with a knob-shaft aperture in the channel base; and the helical worm gearing is positioned in worm-drive contact with toothed gearing on the adjustment shaft, such that rotation of the helical worm gearing by rotation of the adjustment knob rotates the adjustment shaft in a shaft axis that is orthogonal to a knob axis.

11. A drywall-sheet trimmer as described in claim 10 wherein:

the adjustment knob has at least one pinion gear with pinion teeth; and the at least one slide rod has rack teeth that are sized, shaped, structured and positioned to mesh with the pinion teeth, such that rotation of the adjustment shaft by selective rotation of the adjustment knob positions the slide bar selectively intermediate the channel base and a cutting section of the first-wall cutter disk and the second-wall cutter disk.

12. A drywall-sheet trimmer as described in claim 11 wherein:

the at least one slide rod has a plurality of slide rods having rack teeth;

the at least one slideway has a plurality of slideways which match the plurality of slide rods;

the adjustment shaft has a plurality of pinion gears with pinion teeth; and the plurality of slide rods have rack teeth that are sized, shaped, structured and positioned to mesh with respective pinion teeth of the plurality of pinion gears, such that rotation of the adjustment shaft by selective rotation of the adjustment knob positions the slide bar selectively intermediate the channel base and a cutting section of the first-wall cutter disk and the second-wall cutter disk.

13. A drywall-sheet trimmer as described in claim 10 wherein:

the adjustment knob has a conically tapered top section that is extended from a cylindrical section of the adjustment knob.

* * * * *